US011246001B2

(12) United States Patent
Gray

(10) Patent No.: US 11,246,001 B2
(45) Date of Patent: Feb. 8, 2022

(54) ACOUSTIC CROSSTALK CANCELLATION AND VIRTUAL SPEAKERS TECHNIQUES

(71) Applicant: THX Ltd., San Francisco, CA (US)

(72) Inventor: Russell Gray, San Francisco, CA (US)

(73) Assignee: THX Ltd., San Francisco, CA (US)

( * ) Notice: Subject to any disclaimer, the term of this patent is extended or adjusted under 35 U.S.C. 154(b) by 0 days.

(21) Appl. No.: 16/857,033

(22) Filed: Apr. 23, 2020

(65) Prior Publication Data

US 2021/0337336 A1 Oct. 28, 2021

(51) Int. Cl.
*H04S 7/00* (2006.01)

(52) U.S. Cl.
CPC ..... *H04S 7/30* (2013.01); *H04S 2400/09* (2013.01); *H04S 2420/01* (2013.01)

(58) Field of Classification Search
None
See application file for complete search history.

(56) References Cited

U.S. PATENT DOCUMENTS 6,243,476 B1 6/2001 Gardner et al.
6,442,277 B1 * 8/2002 Lueck ..... H04S 5/00 381/1
6,449,368 B1 9/2002 Davis et al.
6,584,205 B1 6/2003 Croft, III et al.
6,920,223 B1 7/2005 Fosgate
7,933,421 B2 4/2011 Asada
8,068,406 B2 11/2011 Kim et al.
8,379,868 B2 2/2013 Goodwin et al.
9,154,896 B2 10/2015 Mahabub et al.
9,173,032 B2 10/2015 Brungart et al.
(Continued)

FOREIGN PATENT DOCUMENTS

WO 2017165968 A1 10/2017

OTHER PUBLICATIONS

Wang et al., "A Stereo Crosstalk Cancellation System Based on the Common-Acoustical Pole/Zero Model," Hindawi Publishing Corporation, EURASIP Journal on Advances in Signal Processing, vol. 2010, Article ID 719197, (2010), 13 pages.
(Continued)

*Primary Examiner* — Qin Zhu
(74) *Attorney, Agent, or Firm* — Schwabe, Williamson & Wyatt, P.C.

(57) ABSTRACT

Embodiments provide methods, apparatuses, and systems for performing crosstalk cancellation and/or generation of virtual speakers. An audio processor may include a crosstalk cancellation circuit and a linearization circuit. The linearization circuit may offset the frequency response of the crosstalk cancellation circuit to provide an overall frequency response that is flat. A virtual speaker circuit may receive an input signal associated with an output channel and pass the input signal to the output channel unmodified. The virtual speaker circuit generates a virtualization signal based on the input signal and passes the virtualization signal to another physical channel. The virtualization signal may be generated further based on an ipsilateral head-related transfer function (HRTF) and a contralateral HRTF that correspond to a virtual speaker location of a virtual speaker generated by the virtual speaker circuit. Other embodiments may be described and/or claimed.

17 Claims, 7 Drawing Sheets

(56) References Cited

U.S. PATENT DOCUMENTS

| | | | | |
|---|---|---|---|---|
| 9,184,857 | B2 | 11/2015 | Vassiliou et al. | |
| 9,578,440 | B2 | 2/2017 | Otto et al. | |
| 9,794,721 | B2 | 10/2017 | Goodwin et al. | |
| 9,807,538 | B2 | 10/2017 | McGrath et al. | |
| 9,913,064 | B2 | 3/2018 | Peters et al. | |
| 9,961,468 | B2 | 5/2018 | Takeuchi et al. | |
| 10,177,718 | B2 | 1/2019 | Lesso et al. | |
| 10,243,719 | B2 | 3/2019 | Bharadia et al. | |
| 2005/0008170 | A1 | 1/2005 | Pfaffinger et al. | |
| 2010/0039923 | A1 | 2/2010 | Kim et al. | |
| 2010/0303245 | A1 | 12/2010 | Vickers | |
| 2010/0329694 | A1* | 12/2010 | Frankel | H04B 10/5055 398/159 |
| 2011/0026718 | A1 | 2/2011 | Trautmann et al. | |
| 2014/0226824 | A1 | 8/2014 | Walsh | |
| 2014/0270281 | A1* | 9/2014 | Walsh | H04S 3/02 381/300 |
| 2015/0172812 | A1* | 6/2015 | Wu | H04S 1/007 381/71.1 |
| 2016/0050508 | A1 | 2/2016 | Redmann | |
| 2016/0174012 | A1 | 6/2016 | Tan et al. | |
| 2018/0247633 | A1* | 8/2018 | Wu | H04S 3/02 |
| 2018/0262858 | A1 | 9/2018 | Noh et al. | |
| 2019/0045316 | A1 | 2/2019 | Schneider et al. | |
| 2019/0191247 | A1* | 6/2019 | Seidess | H04R 5/02 |
| 2019/0200159 | A1 | 6/2019 | Park et al. | |
| 2019/0394603 | A1 | 12/2019 | Moore | |
| 2020/0336834 | A1* | 10/2020 | Yasuda | H04S 1/00 |

OTHER PUBLICATIONS

Pulkki et al., "Localization of Virtual Sources in Multichannel Audio Reproduction," IEEE Transactions On Speech and Audio Processing, vol. 13, No. 1, Jan. 2005, 17 pages.

International Search Report and Written Opinion dated Jul. 7, 2021 for International Application No. PCT/US2021/025813, 15 pages.

* cited by examiner

ACOUSTIC CROSSTALK CANCELLATION AND VIRTUAL SPEAKERS TECHNIQUES

TECHNICAL FIELD

Embodiments herein relate to the field of audio reproduction, and, more specifically, to acoustic crosstalk cancellation and virtual speakers techniques.

BACKGROUND

In audio reproduction systems, acoustic crosstalk occurs when the left loudspeaker introduces sound energy into the right ear of the listener and/or the right loudspeaker introduces sound energy into the left ear of the listener. Some systems implement a crosstalk cancellation process to remove this unwanted sound energy. However, these crosstalk cancellation processes introduce spectral artifacts (e.g., comb filtering in a feedback operation).

Additionally, some audio reproduction systems implement virtual speaker techniques to cause the listener to perceive sounds as originating from a source other than the physical location of the loudspeakers. This is typically achieved by manipulating the source audio so that it contains psychoacoustic location cues. For example, prior methods perform head-related impulse response (HRIR) convolution on each channel to add psychoacoustic location cues. However, these virtual speaker techniques also introduce spectral artifacts into the output signals.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
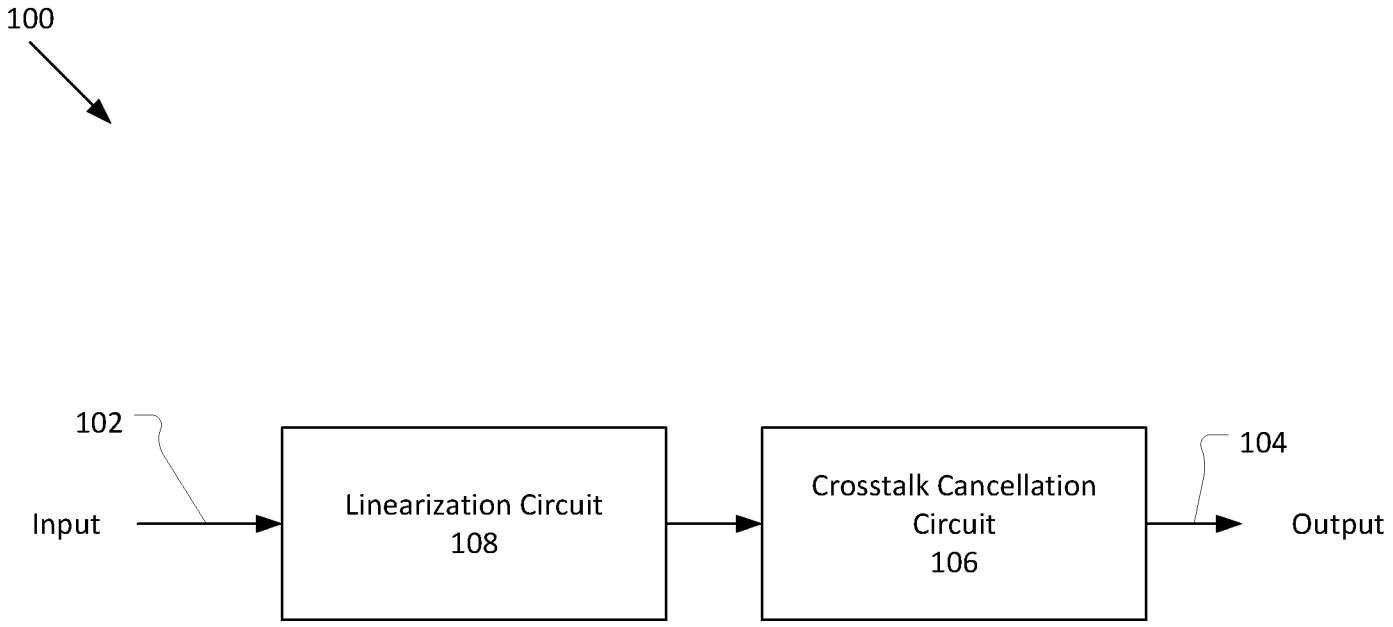
FIG. 1 schematically illustrates an audio processor with a crosstalk cancellation circuit and a linearization circuit, in accordance with various embodiments.

Various embodiments herein describe an audio processor to perform crosstalk cancellation and/or generate one or more virtual speakers. For example, the audio processor may include a crosstalk cancellation circuit and a linearization circuit coupled in series with one another between an input terminal and an output audio terminal. The crosstalk cancellation circuit may provide a crosstalk cancellation signal to the output terminal based on the input signal to cancel crosstalk. The crosstalk cancellation circuit has a first frequency response. The linearization circuit has a second frequency response to provide an overall frequency response for the crosstalk cancellation method that is flat (i.e., equal to 1) over an operating range. For example, the second frequency response may be the inverse of the first frequency response. Accordingly, the combination of the linearization circuit with the crosstalk cancellation circuit may provide crosstalk cancellation for the output signal while also providing a flat frequency response.

Additionally, or alternatively, the audio processor may include a virtual speaker circuit. The virtual speaker circuit may receive the input signal for a physical channel of a multichannel listening environment. The virtual speaker circuit may pass the input signal unmodified to a first output terminal that is associated with the physical channel (e.g., the ipsilateral output). The virtual speaker circuit may generate a virtualization signal based on the input signal and provide the virtualization signal to a second output terminal that is associated with a second physical channel (e.g., the contralateral output). The virtualization signal may be generated further based on an ipsilateral head-related transfer function (HRTF) and a contralateral HRTF that correspond to a virtual speaker location of the virtual speaker, as described further below. Accordingly, the virtual speaker method may not introduce spectral artifacts into the ipsilateral output. Additionally, the virtual speaker method may operate in real time and may require limited digital signal processing resources, allowing it to be deployed across a broad spectrum of product price categories.

These and other embodiments are described in further detail below.

In the present detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the detailed description is not to be taken in a limiting sense.

Various operations may be described as multiple discrete operations in turn, in a manner that may be helpful in understanding embodiments; however, the order of description should not be construed to imply that these operations are order-dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

As used herein, the terms "circuitry" or "circuit" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

FIG. 1 illustrates an audio processor 100 in accordance with various embodiments. The audio processor 100 may receive an input audio signal x[n] at an input terminal 102 and may generate an output audio signal y[n] at an output terminal 104. The audio processor 100 may include a crosstalk cancellation circuit 106 and a linearization circuit 108 coupled in series with one another between the input terminal 102 and the output terminal 104. For example, in some embodiments, the crosstalk cancellation circuit 106 may be coupled after the linearization circuit 108 along the signal path (e.g., between the linearization circuit 108 and the output terminal 104).

In some embodiments, the input audio signal x[n] may correspond to one channel of an audio reproduction system with multiple channels. The audio reproduction system may include audio processors 100 for respective individual channels of the system. In some embodiments, the audio processor 100 may be implemented in a two-channel audio system having a left speaker and a right speaker. Additionally, or alternatively, the audio processor 100 may be implemented in a multi-channel audio system having more than two speakers (e.g., a surround sound system). The multi-channel audio system may include additional speakers in the same plane as the left and right speakers (e.g., listener-level speakers) and/or additional speakers in one or more other planes (e.g., height speakers).

In various embodiments, the audio processors 100 for different channels may be implemented in a same processing circuit (e.g., digital signal processor) in some embodiments, and may or may not include shared components. Alternatively, or additionally, an audio reproduction system may include multiple integrated circuits with separate audio processors for one or more respective channels. In some embodiments, the audio processor 100 may receive the input audio signal as a digital signal (e.g., from a digital source and/or via an analog-to-digital converter (ADC)). The output audio signal may be converted to an analog audio signal by a digital-to-analog (DAC) converter prior to being passed to the speakers.

In various embodiments, the crosstalk cancellation circuit 106 may generate the output audio signal based on its input audio signal to cancel crosstalk artifacts in the audio signal (e.g., to prevent sound energy that is intended for one ear of the listener from reaching the other ear of the listener). The crosstalk cancellation circuit 106 may have a non-linear frequency response, as further discussed below with respect to FIG. 2. Accordingly, the crosstalk cancellation circuit 106 may introduce spectral artifacts into the output signal.

In various embodiments, the linearization circuit 108 may be included to offset the frequency response of the crosstalk cancellation circuit 106 to provide an overall frequency response of the audio processor 100 that is flat (e.g., over an operating range of the crosstalk cancellation circuit 106 and/or linearization circuit 108). For example, the linearization circuit 108 may pre-distort the input audio signal x[n] to generate an intermediate audio signal m[n] that is provided to the crosstalk cancellation circuit 106. The crosstalk cancellation circuit 106 may process the intermediate audio signal m[n] to generate the output audio signal y[n]. The frequency response of the linearization circuit 108 may be the inverse of the frequency response of the crosstalk cancellation circuit 106. Accordingly, with both the linearization circuit 108 and crosstalk cancellation circuit 106 processing the audio signal, the overall frequency response may be flat while also providing the desired crosstalk cancellation. These concepts are further described below with respect to FIG. 2.

Figure 2:
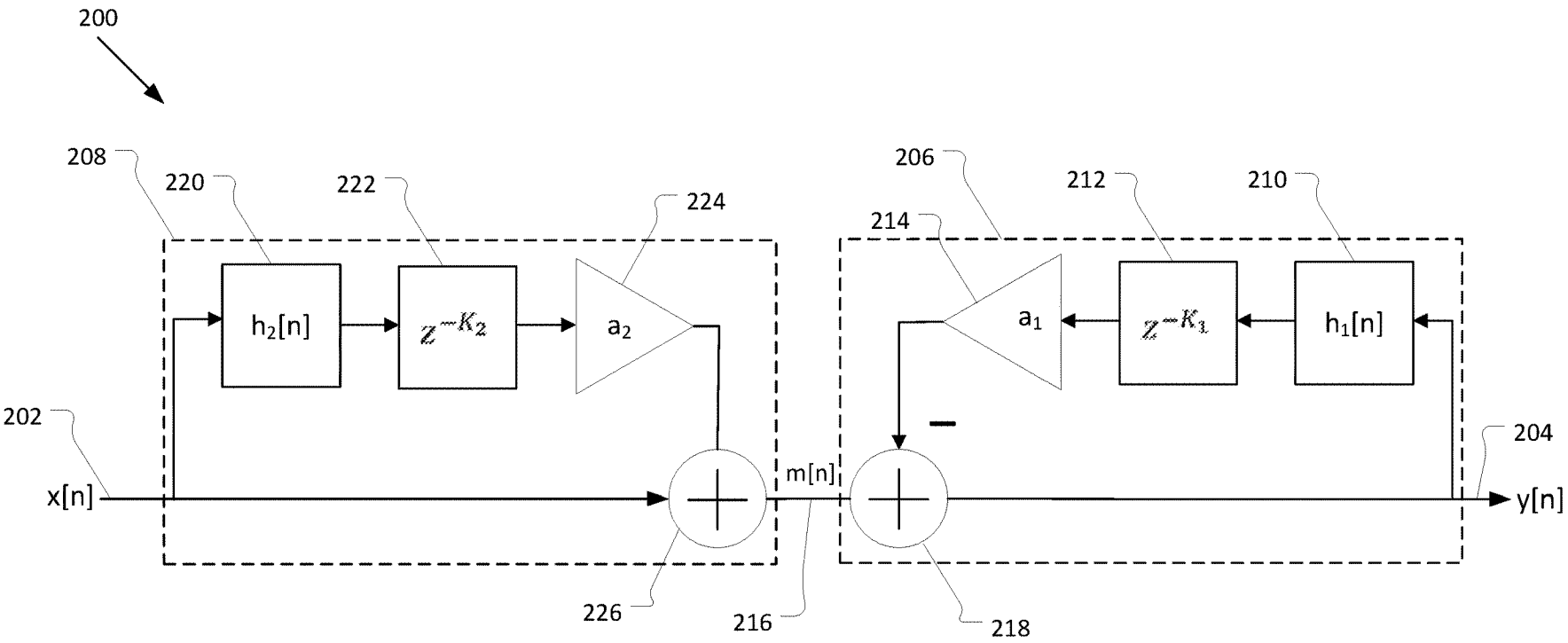
FIG. 2 schematically illustrates an example implementation of a crosstalk cancellation circuit and a linearization circuit, in accordance with various embodiments.

FIG. 2 illustrates an audio processor 200 that may correspond to the audio processor 100 in accordance with various embodiments. The audio processor 200 may receive an input audio signal x[n] at an input terminal 202 and provide an output audio signal y[n] at an output terminal 204. As discussed above, in some embodiments, the input audio signal x[n] may correspond to one channel of an audio reproduction system with multiple channels.

In various embodiments, the audio processor 200 may include a crosstalk cancellation circuit 206 and a linearization circuit 208 coupled in series with one another (also referred to as cascaded) between the input terminal 202 and the output terminal 204. For example, the linearization circuit 208 may be coupled earlier in the signal path than the crosstalk cancellation circuit 206, as shown in FIG. 2. The linearization circuit 208 may receive the input audio signal x[n] and generate an intermediate audio signal m[n] that is provided to the crosstalk cancellation circuit 206 (e.g., at intermediate node 216). The crosstalk cancellation circuit 206 may receive the intermediate audio signal m[n] and generate the output audio signal y[n]. The crosstalk cancellation circuit 206 shown in FIG. 2 may illustrate one signal path of a larger crosstalk cancellation circuit that includes multiple inputs and outputs (e.g., corresponding to different input channels and/or output channels).

In various embodiments, the crosstalk cancellation circuit 206 may modify its input audio signal (e.g., m[n]) to cancel crosstalk artifacts. For example, the crosstalk cancellation circuit 206 may include a filter 210, a delay element 212, and/or attenuation element 214 coupled in a feedback loop from the output terminal 204 to an adder 218 that is coupled to the input of the crosstalk cancellation circuit 206 (e.g., intermediate node 216). The feedback from the feedback loop of the crosstalk cancellation circuit 206 is subtracted from the input audio signal by adder 218 to generate the output audio signal y[n] at the output terminal 204. Some embodiments may include additional feedback loops and/or additional or different processing elements on the feedback loop of the crosstalk cancellation circuit 206.

The values and/or configuration of the filter 210, delay element 212, and/or attenuation element 214 may be determined based on any suitable factors, such as the system configuration (e.g., number of speakers and/or speaker layout), anticipated, measured, or determined listener location, head-related transfer functions, intended output functionality, etc.

Looking at the crosstalk cancellation circuit 206 in isolation (e.g., without the linearization circuit 208), the output of the crosstalk cancellation circuit 206 (y[n]) in the discrete time domain based on the input of the crosstalk cancellation circuit 206 (m[n]) may be given by Equation (1):

$$y[n]=m[n]-a_1(y[n-K_1]*h_1[n]) \tag{1}$$

where $K_1$ is a delay value of the delay element 212, $a_1$ is an attenuation value of the attenuation element 214, and $h_1[n]$ is a filter function of the filter 210.

Transforming Equation (1) to the frequency domain and performing some algebraic manipulations results in the frequency response of the crosstalk cancellation circuit 206 according to Equation (2):

$$\frac{Y(z)}{M(z)}=\frac{1}{1+a_1H_1(z)z^{-K_1}} \tag{2}$$

Accordingly, as demonstrated by Equation (2), the crosstalk cancellation provided by the feedback loop of the crosstalk cancellation circuit 206 has a frequency response that is not uniform (e.g., introduces spectral artifacts).

In various embodiments, the linearization circuit 208 generates the intermediate audio signal m[n] that is provided as the input to the crosstalk cancellation circuit 206 to balance the frequency effects of the feedback loop and provide an overall frequency response of the audio processor 200 to be uniform. For example, the linearization circuit 208 may include a filter 220, a delay element 222, and/or attenuation element 224 coupled in a feedforward loop from the input terminal 202 to an adder 226 that is coupled to the intermediate node 216. The feedforward signal from the feedforward loop is added to the output of the linearization circuit 208 by adder 226 to generate the intermediate audio signal m[n].

Looking at the linearization circuit 208 in isolation, the output of the linearization circuit 208 is given by Equation (3):

$$m[n]=x[n]+a_2(x[n-K_2]*h_2[n]) \tag{3}$$

where $K_2$ is a delay value of the delay element 222, $a_2$ is an attenuation value of the attenuation element 224, and $h_2[n]$ is a filter function of the filter 220.

Transforming Equation (3) to the frequency domain and performing some algebraic manipulations yields the frequency response of the feedforward loop 208 according to Equation (4):

$$\frac{M(z)}{X(z)}=1+a_2H_2(z)z^{-K_2} \tag{4}$$

Figure 5:
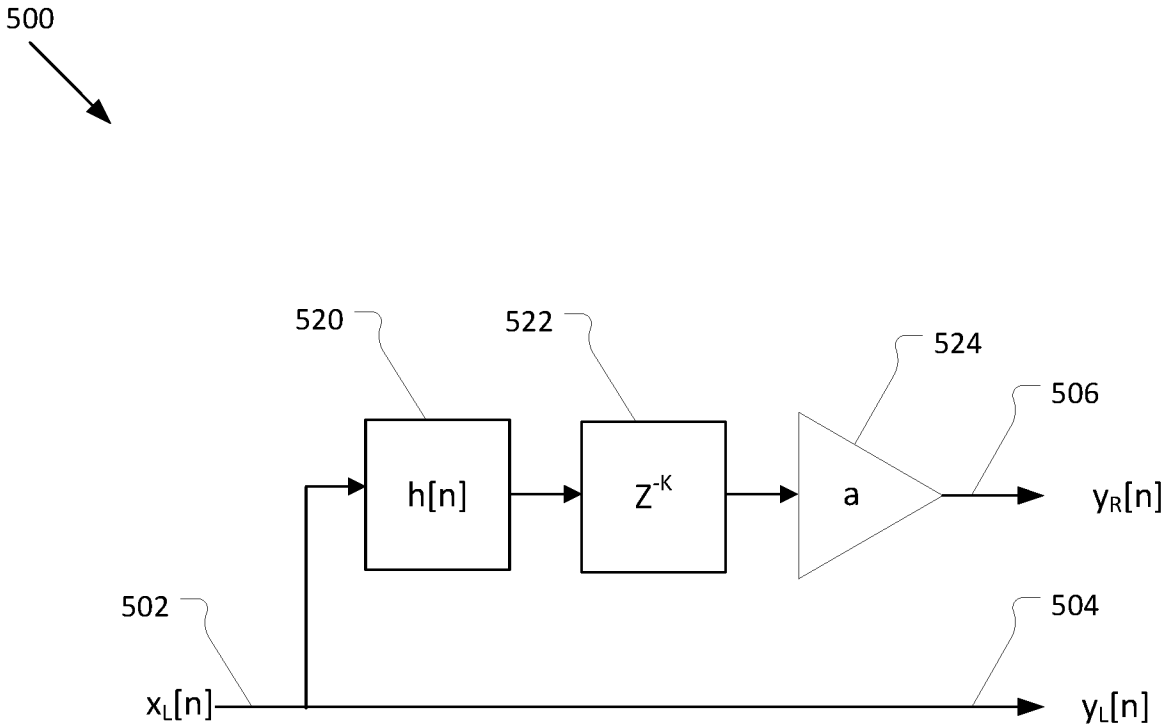
FIG. 5 schematically illustrates an example implementation of a virtual speaker circuit, in accordance with various embodiments.

Combining Equation (2) and Equation (4) provides the overall frequency response of the audio processor 200 shown in FIG. 5):

$$\frac{Y(z)}{X(z)}=\frac{1+a_2H_2(z)z^{-K_2}}{1+a_1H_1(z)z^{-K_1}} \tag{5}$$

Thus, it can be seen that the overall frequency response of the audio processor 200 will be 1 (i.e., flat across the frequency spectrum) if the following conditions are met:

$$a_1=a_2, H_1(z)=H_2(z), K_1=K_2 \tag{6}$$

Therefore, the elements of the feedback loop of the crosstalk cancellation circuit 206 and the feedforward loop of the linearization circuit 208 may be designed and/or controlled to meet the above conditions in Equations (6). For example, a control circuit (e.g., implemented in a digital signal processor) may control the values of the filter, delay, attenuation, and/or other values to be the same across the feedback loop and feedforward loop to be the same between the feedback loop(s) and corresponding feedforward loop(s).

The audio processor 200 may include multiple crosstalk cancellation circuits 206 and linearization circuits 208 and/or additional signal paths to generate the output audio signals from two or more input audio signals (e.g., corresponding to different channels). The resulting audio processor 200 will cancel the acoustic crosstalk in the audio signal while also providing a flat frequency response. The elements of audio processor 200 may be configured with any desired delay, band of operation, and/or attenuation level (e.g., by adjusting the values of the filters 210 and 220, delay elements 212 and 222, and/or attenuation elements 214 and 224), so long as the conditions in Equations (6) remain.

As discussed above, also described herein is an audio processing method for virtual speakers, and associated apparatuses and systems. The virtual speakers method may create an immersive spatial audio listening environment reproduced from a loudspeaker system containing two or more discrete drive units (e.g., speakers) from stereo or multichannel (e.g., more than two channels) source audio. The multichannel listening environment may include two or more physical speakers that correspond to respective physical channels of the environment. The multichannel listening environment may further include one or more virtual speakers associated with respective virtual speaker locations that are different from the locations of the physical speakers. The virtual speakers may be generated by the virtual speakers method by modifying the audio signal provided to one or more of the physical speakers to cause the listener to perceive the virtual output channels as coming from the respective virtual speaker locations. In various embodiments, the physical speakers may include headphone speakers and/or outboard speakers.

Figure 3:
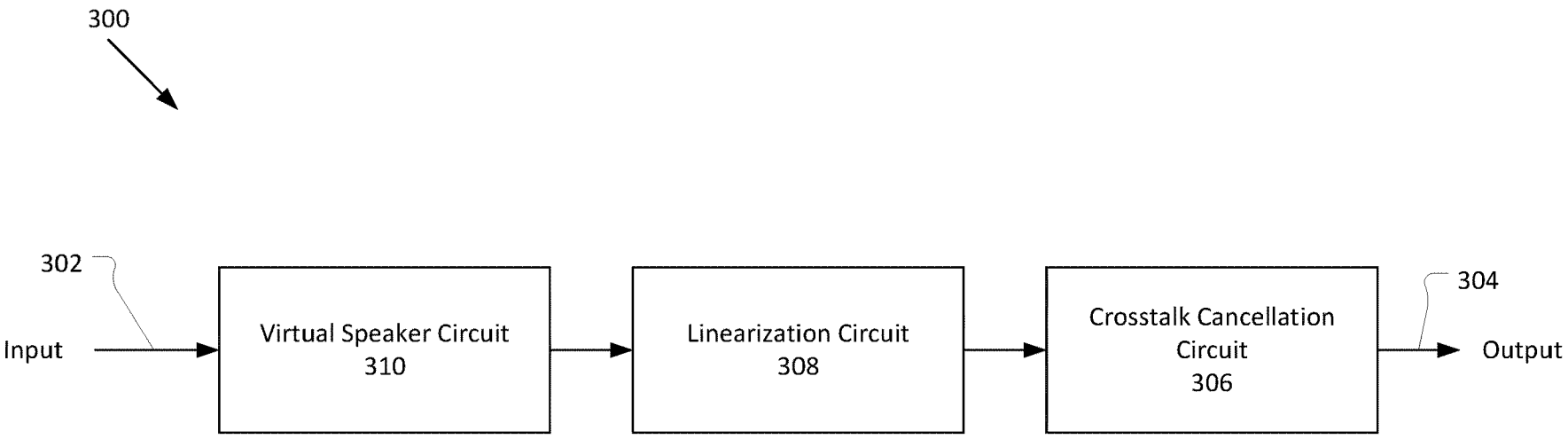
FIG. 3 schematically illustrates an audio processor with a virtual speaker circuit, a crosstalk cancellation circuit, and a linearization circuit, in accordance with various embodiments.

In various embodiments, the virtual speaker method may be implemented in addition to the linear crosstalk cancellation process described herein to generate an immersive listening environment that is free from spectral artifacts. For example, FIG. 3 illustrates an audio processor 300 in accordance with some embodiments. The audio processor 300 includes a linearization circuit 308 and a crosstalk cancellation circuit 306 coupled between an input terminal 302 and an output terminal 304. The linearization circuit 308 and/or crosstalk cancellation circuit 306 may correspond to the respective linearization circuit 108 and/or 208 and/or the crosstalk cancellation circuit 106 and/or 206 described herein. The audio processor 300 may further include a virtual speaker circuit 310 coupled between the input terminal 302 of the audio processor 300 and the input of the linearization circuit 308. The virtual speaker circuit 310 may implement the virtual speaker method described herein.

Figure 4:
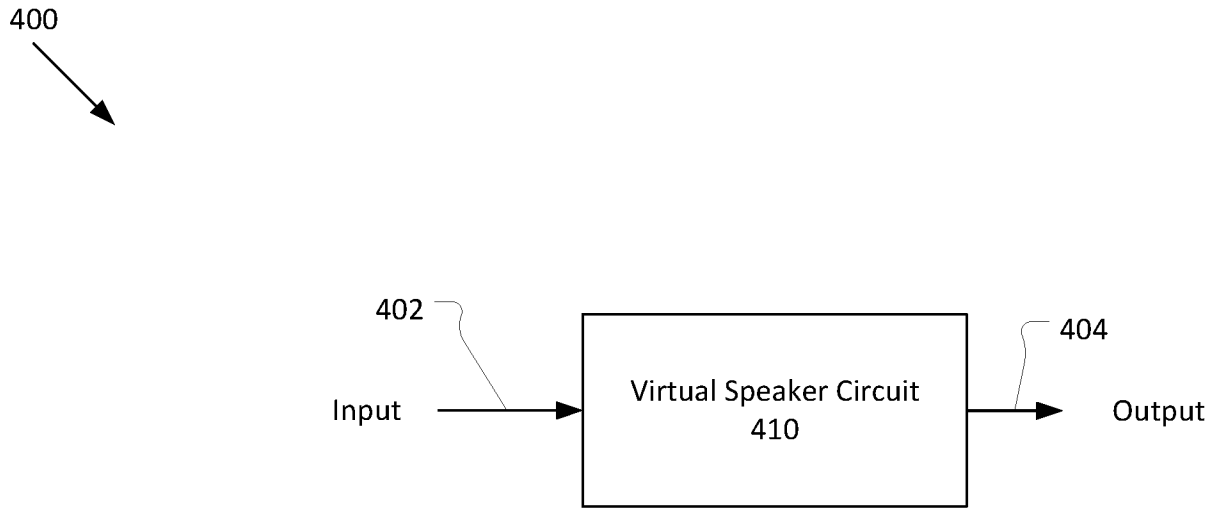
FIG. 4 schematically illustrates an audio processor with a virtual speaker circuit, in accordance with various embodiments.

Alternatively, the virtual speakers method may be implemented without crosstalk cancellation (e.g., when used with headphones) or with a different crosstalk cancellation method than is described herein. For example, FIG. 4 illustrates an audio processor 400 that includes a virtual speaker circuit 410 coupled in series between an input terminal 402 and an output terminal 404. The virtual speaker circuit 410 may implement the virtual speaker method described herein.

In various embodiments of the virtual speaker method, for a given input channel that is associated with a physical output channel, the input audio signal may be passed to the corresponding physical speaker without any modification by the virtual speaker processing method (although the input audio signal may be processed by other processing operations that may be used, such as crosstalk cancellation). The virtual speaker may be generated by providing an additional virtualization audio signal to one or more other physical speakers.

The virtual speakers method may operate by creating difference filters which are applied to the incoming audio stream along with additional signal processing to give psychoacoustic cues to the listener in order to create the impression of a surround sound environment. The method may be implemented on any playback device which contains two separately addressable acoustic playback channels with the transducers physically separated from one another.

For example, FIG. 5 illustrates a virtual speaker circuit 500 that may implement the virtual speaker method in accordance with various embodiments. In some embodiments, the virtual speaker circuit 500 may correspond to the virtual speaker circuit 310 and/or 410. The virtual speaker circuit 500 may receive an input signal $x_L[n]$ at input terminal 502. The input signal $x_L[n]$ may correspond to a physical channel (e.g., the left speaker channel) of a multichannel listening environment. The virtual speaker circuit 500 may pass the input signal $x_L[n]$ unmodified to a first output terminal 504 that corresponds to the physical channel (e.g., is passed to the physical speaker and/or a subsequent processing circuit (e.g., the linearization circuit and/or crosstalk cancellation circuit) for the physical channel). Thus, the output signal $y_L[n]$ for the physical channel is the same as the input signal $x_L[n]$ for the physical channel.

Additionally, the virtual speaker circuit 500 may generate a virtualization signal $y_R[n]$ based on the input signal $x_L[n]$ and may pass the virtualization signal to a second output terminal 506 that corresponds to a different physical channel (e.g., the right speaker channel in this example). The virtualization signal may be further generated based on an ipsilateral HRTF and a contralateral HRTF that correspond to the virtual speaker location of the virtual speaker, as described further below. For example, in some embodiments, the virtual speaker circuit 500 may include a filter 520, an attenuation element 524, and/or a delay element 522 to provide respective filtering, attenuation, and delay to the input signal $x_L[n]$ to generate the virtualization signal $y_R[n]$. Other embodiments may include fewer components, additional components, and/or a different arrangement of components to generate the virtualization signal.

Figure 6:
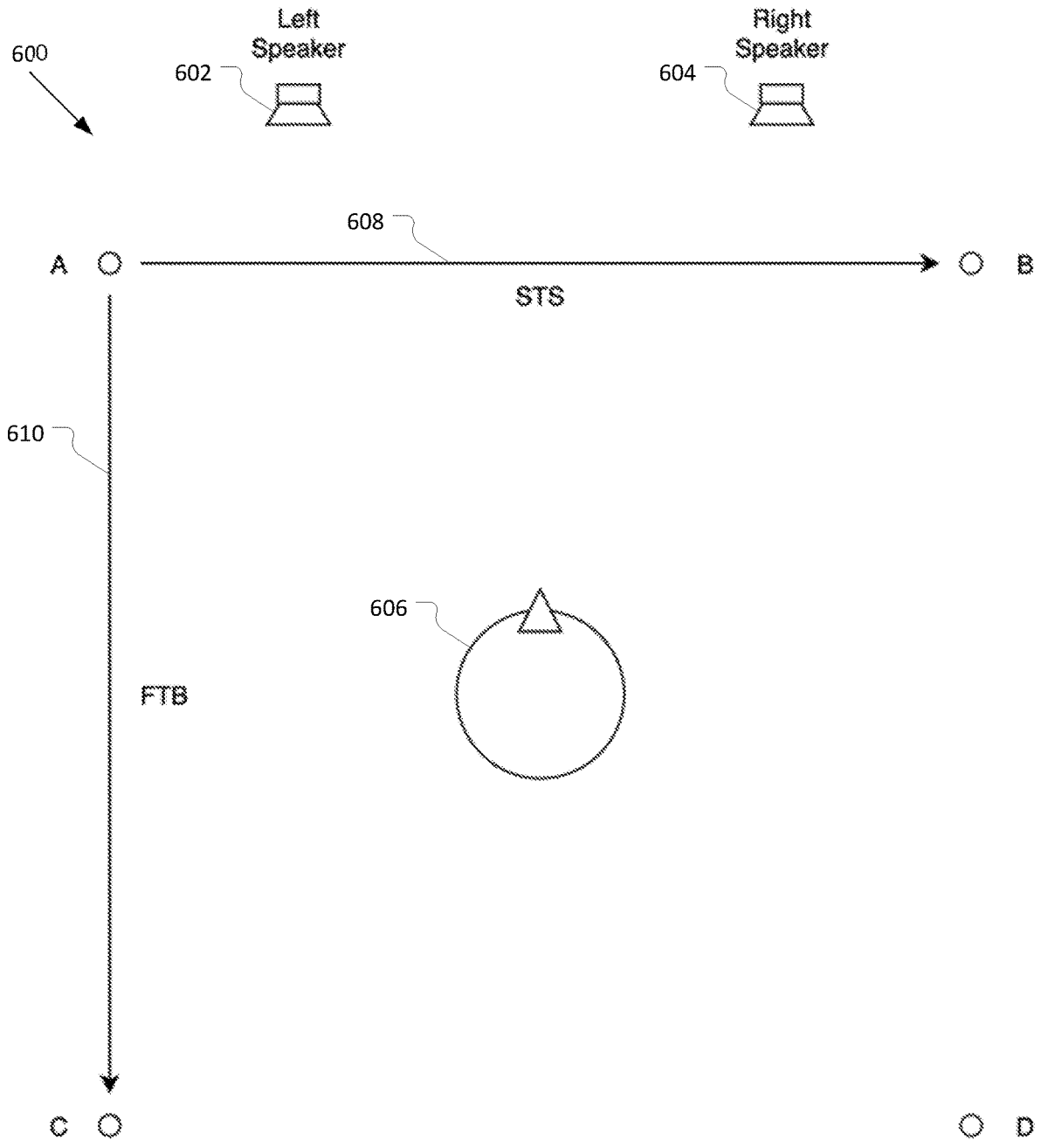
FIG. 6 schematically illustrates a listening environment to demonstrate a virtual speaker method, in accordance with various embodiments.

FIG. 6 illustrates a listening environment 600 in which the virtual speaker method may be implemented. The listening environment 600 may include a left speaker 602 and a right speaker 604. The virtual speakers method may be implemented by considering a listening position 606 positioned relative to the speakers 602 and 604. For example, the speakers 602 and 604 may be positioned such that the reference axes of both speakers 602 and 604 are parallel both to one another and to an imaginary line drawn parallel to the ground from the tip of the nose of a listener at the listening position 606 to the back of the listener's head with the listening position 606 equidistant from both sources. One implementation of the technology processes incoming stereo audio to an azimuth-only spatial environment (e.g. no generated elevation cues). In some embodiments, modifications to the method may be made to implement other speaker arrangements and/or listener positions. For example, some embodiments may include virtual height channels with elevation cues.

In the listening environment 600, the listening position 606 may be located at the center of a box defined at the corners by points A, B, C, and D. In a prior audio spatialization approach, incoming audio is convolved with head-related impulse response (HRIR) data to generate appropriate delays and spectral shifts and thereby encode the audio with positional or localization information. One drawback to this method is that it introduces spectral changes into all processed audio. In contrast, the virtual speakers method described herein may create a spatialized sound field at the listening position without introducing any spectral change.

The virtual speakers method will be described with respect to listening environment 600, to spatialize a stereo audio signal for playback through stereo physical speakers. For ease of understanding, the process is described with respect to one channel of incoming stereo audio. The process for the other channel of incoming audio is the same except for the channel designations. The process may also be used with more than two physical speakers (e.g., by including additional process paths and/or modifying how the spatialization signals are distributed across multiple physical speakers).

In one method of virtualization, the left incoming time-domain audio channel $x_L$ is convolved with the two channels of the HRIR corresponding to the desired left side localization: ipsilateral ($h_{LL}$) and contralateral ($h_{LR}$). The result is two output signals, one sent to the left channel of the reproduction system ($y_L$) and one sent to the right channel of the reproduction system ($y_R$):

$$y_L = h_{LL} * x_L \quad y_R = h_{LR} * x_L \tag{7}$$

Transforming Equations (7) to the frequency domain yields Equations (8):

$$Y_L = H_{LL} X_L \quad Y_R = H_{LR} X_L \tag{8}$$

Equations (8) can be rearranged to obtain an expression for the contralateral output in terms of the ipsilateral output:

$$\frac{Y_R = H_{LR} X_L}{Y_L = H_{LL} X_L} \rightarrow \frac{Y_R}{Y_L} = \frac{H_{LR} X_L}{H_{LL} X_L} = \frac{H_{LR}}{H_{LL}} \rightarrow Y_R = \frac{H_{LR}}{H_{LL}} Y_L \tag{9}$$

The final form of Equation (9) shows that the psychoacoustic localization effect imparted by the contralateral output signal is a linear function of the ipsilateral output signal, modified by the difference between ipsilateral and contralateral head-related transfer functions (HRTFs) in the frequency domain. In accordance with various embodiments herein, the ipsilateral output of the virtual speakers process is the unmodified input channel. Accordingly, the contralateral output may be generated based on Equation (9). For example, the ipsilateral output and contralateral output of the virtual speakers method may be as follows:

$$Y_L = X_L \Rightarrow Y_R = \frac{H_{LR}}{H_{LL}} X_L \tag{10}$$

Accordingly, in various embodiments, spatialized signals may be generated arbitrarily from source audio across any listening dimension by applying a filter (e.g., applied by filter 520 of FIG. 5) equivalent to the ratio of two HRTFs corresponding to the intended localization origins. Referring again to FIG. 6, a side-to-side (STS) process 608 may be applied to spatialize input audio in the A-B dimension. Additionally, or alternatively, a front-to-back (FTB) process 610 may be applied to spatialize input audio in the A-C dimension. The processes 608 and/or 610 may include additional signal processing elements such as delay, attenuation, and phase adjustment (e.g., as shown in FIG. 5) in order to create the proper localization cues. The phase adjustment may be provided by the filter 520, e.g., using one or more all-pass filters.

Some embodiments may include a spatialization process in one or more other dimensions, in addition to or instead of the STS process 608 and/or FTB process 610. For example, some embodiments may additionally or alternatively include an elevation process to spatialize input audio in a vertical dimension, and/or a diagonal spatialization process to spatialize input audio in a diagonal dimension.

Figure 7:
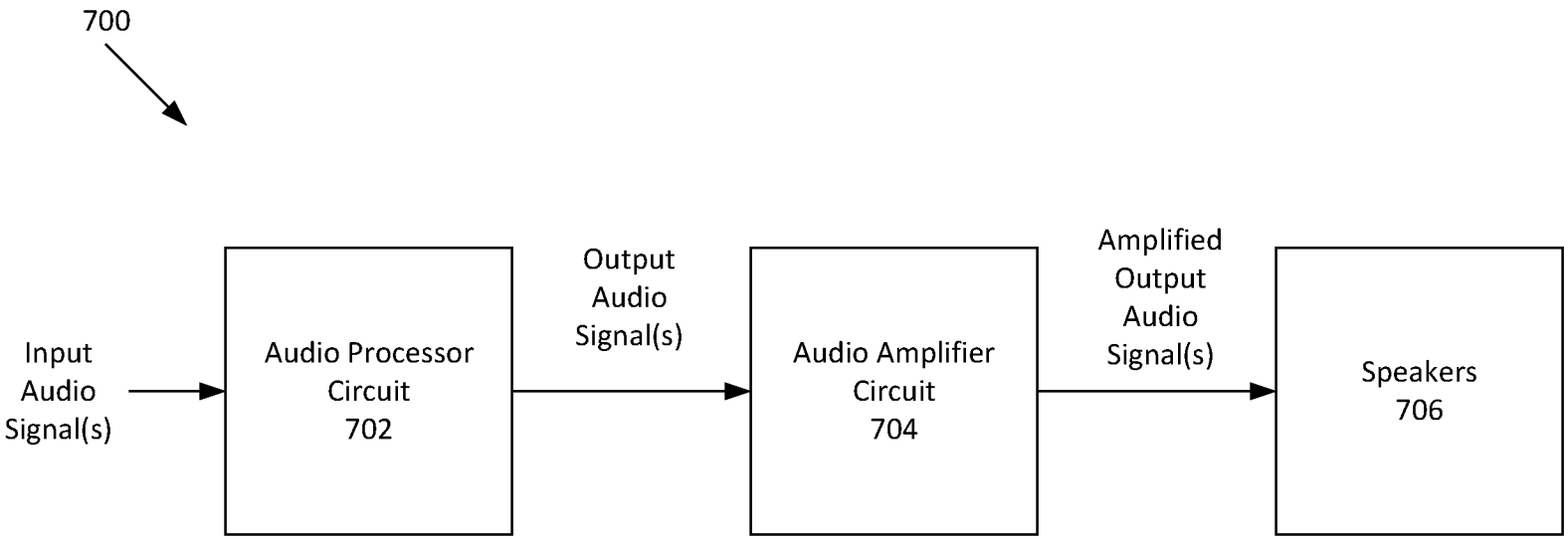
FIG. 7 schematically illustrates an audio reproduction system that may implement the crosstalk cancellation method and/or virtual speaker method described herein, in accordance with various embodiments.

In various embodiments, the crosstalk cancellation method and/or virtual speakers method described herein may be implemented in any suitable audio reproduction system. FIG. 7 schematically illustrates one example of a system 700 that includes an audio processor circuit 702 that may implement the crosstalk cancellation method and/or virtual speakers method. For example, the audio processor circuit 702 may include the audio processor 100, 200, 300, and/or 400, and/or the virtual speaker circuit 500 described herein.

In various embodiments, the system 700 may receive an input audio signal, which may be a multi-channel input audio signal. The input audio signal may be received in digital and/or analog form. The input audio signal may be received from another component of the system 700 (e.g., a media player and/or storage device) and/or from another device that is communicatively coupled with the system 700 (e.g., via a wired connection (e.g., Universal Serial Bus (USB), optical digital, coaxial digital, high definition media interconnect (HDMI), wired local area network (LAN), etc.) and/or wireless connection (e.g., Bluetooth, wireless local area network (WLAN, such as WiFi), cellular, etc.).

In various embodiments, the audio processor circuit 702 may generate an output audio signal and pass the output audio signal to the amplifier circuit 704. The audio processor circuit 702 may implement the crosstalk cancellation circuit(s) and/or virtual speaker circuit(s) described herein to provide crosstalk cancellation and/or generate virtual speaker(s), respectively. The output audio signal may be a multi-channel audio signal with two or more output channels.

The amplifier circuit 704 may receive the output audio signal from the audio processor circuit 702 via a wired and/or wireless connection. The amplifier circuit 704 may amplify the output audio signal received from the audio processor circuit 702 to generate an amplified audio signal. The amplifier circuit 704 may pass the amplified audio signal to two or more physical speakers 706. The speakers 706 may include any suitable audio output devices to generate an audible sound based on the amplified audio signal, such as outboard speakers and/or headphone speakers. The speakers 706 may be standalone speakers to receive the amplified audio signal from the amplifier circuit and/or may be integrated into a device that also includes the amplifier circuit 704 and/or audio processor circuit 702. For example, the speakers 706 may be passive speakers that do not include an amplifier circuit 704 and/or active speakers that include the amplifier circuit 704 integrated into the same device.

In one example, the speakers 706 may be headphone speakers, e.g., with a left speaker to provide audio to the listener's left ear and a right speaker to provide audio to the listener's right ear. The headphones may receive input audio via a wired and/or wireless interface. The headphones may or may not include an audio amplifier 704 (e.g., for audio reproduction from a wireless interface). In some embodiments, the headphones may include an audio processor circuit 702 to apply the virtual speaker method described herein. Alternatively, the headphones may receive the processed audio from another device after application of the virtual speakers method.

In various embodiments, some or all elements of the system 700 may be included in any suitable device, such as a mobile phone, a computer, an audio/video receiver, an integrated amplifier, a standalone audio processor (including an audio/video processor), a powered speaker (e.g., a smart speaker or a non-smart powered speaker), headphones, an outboard USB DAC device, etc.

In various embodiments, the audio processor circuit 702 may include one or more integrated circuits, such as one or more digital signal processor circuits. Additionally, or alternatively, the system 700 may include one or more additional components, such as one or more processors, memory (e.g., random access memory (RAM), mass storage (e.g., flash memory, hard-disk drive (HDD), etc.), antennas, displays, etc.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. An audio processor circuit comprising:

an input terminal to receive an input audio signal;

an output terminal to provide an output audio signal;

a crosstalk cancellation circuit coupled between the input terminal and the output terminal to provide the output audio signal with a crosstalk cancellation signal, wherein the crosstalk cancellation circuit has a first frequency response, wherein the crosstalk cancellation circuit includes a feedback loop with a first filter, a first attenuation element, and a first delay element coupled in the feedback loop between an output of the crosstalk cancellation circuit and an input of the crosstalk cancellation circuit;

a linearization circuit coupled in series with the crosstalk cancellation circuit between the input terminal and the output terminal, wherein the linearization circuit has a second frequency response to provide an overall frequency response for the audio processor circuit that is flat over an operating range of the crosstalk cancellation circuit, wherein the linearization circuit includes a feedforward loop with a second filter, a second attenuation element, and a second delay element coupled in the feedforward loop between an input of the linearization circuit and an output of the linearization circuit.

2. The audio processor circuit of claim 1, further comprising a control circuit to control one or more values of the linearization circuit to be the same as corresponding one or more values of the crosstalk cancellation circuit.

3. The audio processor circuit of claim 1, wherein the linearization circuit is to receive the input audio signal and generate an intermediate audio signal based on the input audio signal, and wherein the crosstalk cancellation circuit is to receive the intermediate audio signal and generate the output audio signal based on the intermediate audio signal.

4. The audio processor circuit of claim 3, wherein the first frequency response of the crosstalk cancellation circuit on a signal path between the input terminal and the output terminal is:

$$\frac{Y(z)}{M(z)} = \frac{1}{1 + a_1 H_1(z) z^{-K_1}}$$

wherein Y(z) is the output audio signal, $K_1$ is a first delay value of the first delay element, $a_1$ is a first attenuation value of the first attenuation element, and $H_1(z)$ is a first filter function of the first filter;

wherein the second frequency response of the linearization circuit is:

$$\frac{M(z)}{X(z)} = 1 + a_2 H_2(z) z^{-K_2}$$

wherein M(z) is the intermediate audio signal, X(z) is the input audio signal, $K_2$ is a second delay value of the second delay element, $a_2$ is a second attenuation value of the second attenuation element, and $H_2(z)$ is a second filter function of the second filter; and wherein:

$$a_1 = a_2, H_1(z) = H_2(z), \text{ and } K_1 = K_2.$$

5. The audio processor circuit of claim 1, wherein the input audio signal is a first input audio signal, and wherein the audio processor circuit further comprises a virtual speaker circuit to:

receive a second input audio signal, wherein the second input audio signal corresponds to a first physical channel of a multichannel listening environment;

pass the second input audio signal to the crosstalk cancellation circuit as the first input audio signal for the first physical channel;

generate a virtual channel of the multichannel listening environment based on the second input audio signal, wherein the virtual channel is associated with a virtual channel location, and wherein to generate the virtual channel, the virtual speaker circuit is to:

generate a virtualization audio signal based on the second input audio signal, an ipsilateral head-related transfer function (HRTF) that corresponds to the virtual channel location, and a contralateral HRTF that corresponds to the virtual channel location; and provide the virtualization audio signal to a second physical channel of the multichannel listening environment.

6. The audio processor circuit of claim 5, wherein the virtual speaker circuit is to pass the second input audio signal to the crosstalk cancellation circuit without modification to the second input audio signal.

7. The audio processor circuit of claim 5, wherein the virtualization audio signal is generated according to:

$$Y_2 = \frac{H_{12}}{H_{11}} X_1$$

wherein $Y_2$ is the virtualization audio signal in the frequency domain, $H_{12}$ is the contralateral HRTF, $H_{11}$ is the ipsilateral HRTF, and Xi is the second input audio signal for the physical channel.

8. An audio processor circuit comprising:

an input terminal to receive an input audio signal that corresponds to a first physical channel of a multichannel listening environment;

a virtual speaker circuit coupled to the input terminal, the virtual speaker circuit to generate a virtual channel of the multichannel listening environment based on the input audio signal, wherein the virtual channel is associated with a virtual channel location, and wherein to generate the virtual channel, the virtual speaker circuit is to:

generate a virtualization audio signal based on the input audio signal, an ipsilateral head-related transfer function (HRTF) that corresponds to the virtual channel location, and a contralateral HRTF that corresponds to the virtual channel location;

provide the virtualization audio signal to a second physical channel of the multichannel listening environment; and pass the input audio signal unmodified to the first physical channel for reproduction on a first physical speaker.

9. The audio processor circuit of claim 8, wherein the virtualization audio signal is generated according to:

$$Y_2 = \frac{H_{12}}{H_{11}} X_1$$

wherein $Y_2$ is the virtualization audio signal in the frequency domain, $H_{12}$ is the contralateral HRTF, $H_{11}$ is the ipsilateral HRTF, and Xi is the input audio signal for the first physical channel.

10. The audio processor circuit of claim 8, wherein the input audio signal is a first input audio signal, wherein the virtualization audio signal is a first virtualization audio signal, and wherein the virtual speaker circuit is further to:

receive a second input audio signal associated with the second physical channel of the multichannel listening environment;

generate a second virtualization audio signal for the virtual channel based on the second input audio signal; and provide the second virtualization audio signal to the first physical channel.

11. An audio output system comprising:

an audio processor including:

a linearization circuit to receive an input audio signal and generate an intermediate audio signal based on the input audio signal, wherein the linearization circuit has a first frequency response, wherein the linearization circuit includes a feedforward loop with a first filter, a first attenuation element, and a first delay element coupled in the feedforward loop between an input of the linearization circuit and an output of the linearization circuit; and a crosstalk cancellation circuit to receive the intermediate audio signal and to generate an output audio signal to cancel crosstalk in the intermediate audio signal, wherein the crosstalk cancellation circuit has a second frequency response to provide an overall frequency response for the processor circuit that is flat over an operating range of the crosstalk cancellation circuit wherein the crosstalk cancellation circuit includes a feedback loop with a second filter, a second attenuation element, and a second delay element coupled in the feedback loop between an output of the crosstalk cancellation circuit and an input of the crosstalk cancellation circuit; and an audio amplifier coupled to the audio processor, the audio amplifier to amplify the output audio signal and provide the output audio signal to one or more speakers.

12. The audio output system of claim 11, wherein the crosstalk cancellation circuit includes a feedback loop with a filter, an attenuation element, and a delay element coupled in the feedback loop between an output of the crosstalk cancellation circuit and an input of the crosstalk cancellation circuit.

13. The audio output system of claim 12, wherein the second filter has a same filter function as the first filter, the second attenuation element has a same attenuation value as the first attenuation element, and the second delay element has a same delay value as the first delay element.

14. The audio output system of claim 11, wherein the first frequency response of the linearization circuit is:

$$\frac{M(z)}{X(z)} = 1 + a_2 H_2(z) z^{-K_2}$$

wherein M(z) is the intermediate audio signal, X(z) is the input audio signal, $K_2$ is a linearization delay value of the first delay element, $a_2$ is a linearization attenuation value of the first attenuation element, and $H_2(z)$ is a linearization filter function of the first filter;

wherein the second frequency response of the crosstalk cancellation circuit is:

$$\frac{Y(z)}{M(z)} = \frac{1}{1 + a_1 H_1(z) z^{-K_1}}$$

wherein Y(z) is the output audio signal, $K_1$ is a crosstalk delay value of the second delay element, $a_1$ is a crosstalk attenuation value of the second attenuation element, and $H_1(z)$ is a crosstalk filter function of the second filter; and wherein:

$$a_1 = a_2, H_1(z) = H_2(z), \text{ and } K_1 = K_2.$$

15. The audio output system of claim 11, wherein the input signal is a first input signal, and wherein the audio processor circuit further includes a virtual speaker circuit to:

receive a second input audio signal, wherein the second input audio signal corresponds to a first physical channel of a multichannel listening environment;

pass the second input audio signal unmodified to a first input of the linearization circuit, wherein the first input is for the first physical channel;

generate a virtualization audio signal based on the output audio signal, an ipsilateral head-related transfer function (HRTF) that corresponds to a virtual channel location, and a contralateral HRTF that corresponds to the virtual channel location; and provide the virtualization audio signal to a second input of the linearization circuit to generate a virtual channel associated with the virtual channel location, wherein the second input corresponds to a second physical channel of the multichannel listening environment.

16. The audio output system of claim 15, wherein the virtualization audio signal is generated according to:

$$Y_2 = \frac{H_{12}}{H_{11}} X_1$$

wherein $Y_2$ is the virtualization audio signal in the frequency domain, $H_{12}$ is the contralateral HRTF, $H_{11}$ is the ipsilateral HRTF, and Xi is the second input audio signal for the first physical channel.

17. The audio output system of claim 11, further comprising the one or more speakers coupled to the audio amplifier to receive the amplified output audio signal.

* * * * *